US009968184B2

(12) United States Patent
Palazeti

(10) Patent No.: US 9,968,184 B2
(45) Date of Patent: May 15, 2018

(54) KNOCK DOWN TABLE

(71) Applicant: Martin Palazeti, Howell, MI (US)

(72) Inventor: Martin Palazeti, Howell, MI (US)

( * ) Notice: Subject to any disclaimer, the term of this patent is extended or adjusted under 35 U.S.C. 154(b) by 0 days. days.

(21) Appl. No.: 15/133,884

(22) Filed: Apr. 20, 2016

(65) Prior Publication Data

US 2017/0303678 A1 Oct. 26, 2017

(51) Int. Cl.

| | |
|---|---|
| ***A47B 55/02*** | (2006.01) |
| ***A47B 96/14*** | (2006.01) |
| ***A47B 3/06*** | (2006.01) |
| ***A47B 13/00*** | (2006.01) |
| ***A47B 33/00*** | (2006.01) |

(52) U.S. Cl.
CPC ..... *A47B 3/06* (2013.01); *A47B 13/003* (2013.01); *A47B 33/00* (2013.01)

(58) Field of Classification Search
CPC ..... A47B 3/06; A47B 13/003; A47B 33/00; A47B 13/021; A47B 13/06; A47B 2031/004; A47B 47/0083; A47B 47/0215; A47B 47/0223; A47B 2013/022; F16B 12/40; F16B 12/42; F16B 12/403; F16B 12/406; F16B 12/0466; F16B 7/18; F16B 7/0413; Y10T 403/3986; Y10T 403/55; Y10T 403/7005
USPC ..... 108/180, 181, 182, 186, 187, 189, 190
See application file for complete search history.

(56) References Cited

U.S. PATENT DOCUMENTS 1,549,146 A * 8/1925 Miner ..... A47B 3/06 108/159
1,891,393 A * 12/1932 Oppenlander ..... B62B 3/02 108/189
2,647,000 A * 7/1953 Colley ..... F16B 7/18 256/21
2,950,015 A 8/1960 Pataky
3,783,800 A * 1/1974 Bucker ..... F26B 25/063 108/53.5
3,891,334 A 6/1975 Frank
4,444,125 A * 4/1984 Welsch ..... A47B 3/06 108/147.13
4,662,591 A * 5/1987 Encontre ..... A47B 13/021 108/158
4,786,203 A 11/1988 Conner et al.
4,952,092 A * 8/1990 Ballerstein ..... E04F 11/1817 256/65.1

(Continued)

FOREIGN PATENT DOCUMENTS

GB 2274773 * 8/1994
WO 2004043205 A1 5/2004

OTHER PUBLICATIONS

Figure of John-Boos-Cucina-Americana-Prep-Table-CU-MAR48.
Figure of Omcan 39385 Galvanized Leg Brace for Work Table 30"×60".
Figure: A-Line-by-Advance-Tabco-Prep-Table-with-Wood-Top-TH2S-303RE.
Figure: Benham-Prep-Table-TADN1345.

(Continued)

*Primary Examiner* — Daniel J Troy
*Assistant Examiner* — Timothy M Ayres
(74) *Attorney, Agent, or Firm* — Johsnson Legal PLLC

(57) ABSTRACT

The invention relates to a knock down table suitable for food preparation that includes extension legs and terminal legs that are interconnected with a threaded connector and threaded receiving plugs in the connecting ends of the extension and terminal legs. One of the receiving plugs in each connection protrudes from the end of its legs and is configured to extend into the connecting leg and abut with the receiving plug in the other leg.

10 Claims, 11 Drawing Sheets

(56) References Cited

U.S. PATENT DOCUMENTS

| | | | | | |
|---|---|---|---|---|---|
| 5,165,349 | A * | 11/1992 | McAllister | A47B 13/021 | 108/156 |
| 5,941,183 | A * | 8/1999 | Ming-Shun | A47B 3/06 | 108/153.1 |
| 6,068,143 | A * | 5/2000 | Wang | A47B 57/265 | 108/144.11 |
| 6,626,605 | B1 * | 9/2003 | Dean | F16B 7/025 | 108/147.12 |
| 7,293,936 | B1 * | 11/2007 | Warren | F16B 37/085 | 124/23.1 |
| 7,913,631 | B2 | 3/2011 | Hawkins | | |
| 2006/0260519 | A1 * | 11/2006 | Burns | A47B 13/08 | 108/161 |

OTHER PUBLICATIONS

Figure: Clipboard01.
Figure: Clipboard01John Boos Co KD work table.
Figure: cross rail 1459762490_2716.
Figure: cross rail 316vQ4azQeL.
Figure: cross rail option2.
Figure: Omcan-39385.
Figure: Open frame rough.
Figure: PVIFS-Aluminum-I-Frame-Utility-Table-AIFT3034-PT.
Figure: super-erecta-shelf_0.
Product description: ALINE SS top119423.
Product description: Amazon.com_ Worktable SS KD 24_×72_, EA.

* cited by examiner

KNOCK DOWN TABLE

FIELD OF THE INVENTION

The invention relates to tables that exhibit a configuration that can be disconnected for shipping or transporting the table in a conventional corrugated box and form a stable work surface when reassembled.

BACKGROUND OF THE INVENTION

Stainless steel and similar sterilizable tables are important for the food preparation industry. Such tables provide the necessary work surfaces for cleaning, cutting and assembling foods served to customers. Open table supports provide space for storage of materials used in the food preparation. Models with an undershelf provide additional storage space for bowls and containers. A typical commercial kitchen has use for both open and undershelf tables.

The basic version of an open table uses legs of a tubular or rectangular cross sectional shape that are inserted into mating sockets connected or welded to the underside of the table top. A set screw for each socket provides lateral pressure in the inserted table leg portion to hold the leg within the socket and provide a measure of stability. Greater stability for the table is provided with a support frame made of rigid tubes or bars that are welded between the legs. Similarly, an undershelf can be welded between the legs and serve as the lower support for the table legs.

Metal food preparation tables having all welded connections make for a very stable work surface but at increased cost and difficulty of transporting the unit from manufacturer to customer. Such tables must be shipped in a fully assembled state by large pallets or crates using special equipment that can handle the weight of the fully assembled table unit.

For convenience, transport to offsite events, or reduced shipping costs prep tables have been offered that can be disassembled for transport and reassembled on site. Such tables use an open socket and set screw to attach the legs to the table top. The open table models use a lower support frame in an "H" frame or "C" frame construction and pass-through ferrules of circular or rectangular shape at each corner. Lateral set screws on each ferrule are used to hold the leg in place.

The conventional undershelf for a prep table uses a connection configuration that is similar to those of the open support frame. In particular, the typical undershelf unit would exhibit a pass-through ferrule connection on each corner of the undershelf and set screws to hold the shelf in position on the legs. Unfortunately, the use of set screws and pass-through ferrules for either the open or undershelf models can loosen over time and commercial use so that the table becomes less stable and requires adjustments to all set screws.

The National Sanitation Foundation (NSF) a number of regulations regarding food preparation tables. The currently approved materials are certain types of stainless steel and aluminum alloys. The NSF regulations also mandate that there be no gaps over 1/32" to prevent the growth of bacteria.

It would be desirable to have a knock down prep table that complies with the applicable NSF regulations and which can be readily disassembled for transport and still form a stable work surface when reassembled.

A number of published applications and patents have described connections for tubular joints. For example, U.S. Pat. No. 2,647,000 describes a transverse, permanent connection using a deformed, internally threaded, metal washer or rivet within the joining tube. A bolt extends through aligned openings in the joined tube and into the internally threaded connection of the deformed washer. The washer is initially deformed using a deformation tool that uses a compression anvil around an extended bolt. The anvil engages the edges of the walls of the deformable rivet and, upon advance of the threaded bolt, compresses the rivet walls until they engage and become secured by internal grooves of the joining tube. The tool is then removed leaving the rivet in place ready to receive the connecting bolt during assembly.

U.S. Pat. No. 2,799,519 also describes the use of transverse bolts and an internal rivet to connect tubular members with T-joints.

U.S. Pat. No. 2,950,015 describes a joint system for knock down racks made of joined tubular members. The connections use some members that are spot welded and others that employ frictional fits between tube sections having larger and smaller diameters. One disclosed set of such frictional fits provide an expanded member having an internal, recessed bolt that engages a nut recessed in the member of reduced diameter.

U.S. Pat. No. 4,444,125 describes a knock down work table made with tubular legs having external grooves at increments over the length of each leg. The lower shelf and optional C-shaped support rail have pass-through ferrules at the corners. A frustoconical collar washer having an internal rib engages a leg groove and supports the shelf or support rail by the interaction of the leg groove and internal collar washer rib. U.S. Pat. No. 6,068,143 uses a similar leg groove/collar washer ridge system for upright shelf systems.

U.S. Pat. No. 4,786,203 relates to a connector assembly for food preparation equipment. The assembly is designed to minimize the formation of exposed gaps with a series of threaded connector elements and a locking collar that secure the joining tube to a mating connector that is transversely bolted to the joined tube.

U.S. Pat. No. 4,952,092 describes a system for permanently connecting vertically aligned metal tubes and metal cross-member rails that uses a threaded bolt passing through the vertically aligned tubes and connects the cross-member rails with round plugs forced into bosses protruding from the rails. The rail ends are then welded to the vertical tubes.

It would be desirable to have a joint system for a knockdown table that would allow for assembly into a highly stable work surface that would remain stable over extended time and which is suitable for use in food preparation.

It would also be desirable to have a knockdown food preparation table that can be shipped in a compact, disassembled state and readily re-assembled by the customer to form a highly stable work surface that is suitable for use in food preparation.

SUMMARY OF THE INVENTION

It is an object of the invention to provide a knockdown food preparation table that can be shipped to customers without the need for pallets or crates.

It is further an object of the invention to provide a knockdown food preparation table that can be readily assembled to form a sturdy working surface that complies with all applicable regulations for food preparation or disassembled to a more compact size for shipping.

In accordance with these and other objects of the invention that will become apparent from the description herein, a knock down food preparation table according to the invention comprises: (a) a rectangular table top with a top side, an underside and four corners, (b) four receiving sockets secured to the underside of said table top and located near each corner thereof, (c) four tubular, extension legs of the same length and external dimensions, wherein each extension leg exhibits: (i) a first leg portion end that fits into one of the receiving sockets on the underside of said table top, and (ii) a second leg portion end having a first plug that is secured within said second leg portion end, each said first plug exhibiting an axially-extending, threaded, central bore, and (d) a lower support frame comprising four, tubular, terminal legs that extend from front and back of a top side of said frame to a lower side of said frame, wherein each top end of each terminal leg comprises a second plug fit therein and that exhibits an axially-extending, threaded, central bore to receive a threaded rod so that a second leg portion end of an extension leg can be secured together with said threaded rod, whereby the second leg portion of an extension leg abuts a corresponding top side of a terminal leg, wherein one of said first plug or said second plug protrudes into a tubular leg segment of the other leg when fully twisted together.

The table of the present invention provides a structurally stable support system and a working surface that all comply with the applicable regulations for food preparation while also providing the advantages of ready disassembly for transport without pallets or crates for the assembled table unit.

DETAILED DESCRIPTION OF THE INVENTION

Figure 1:
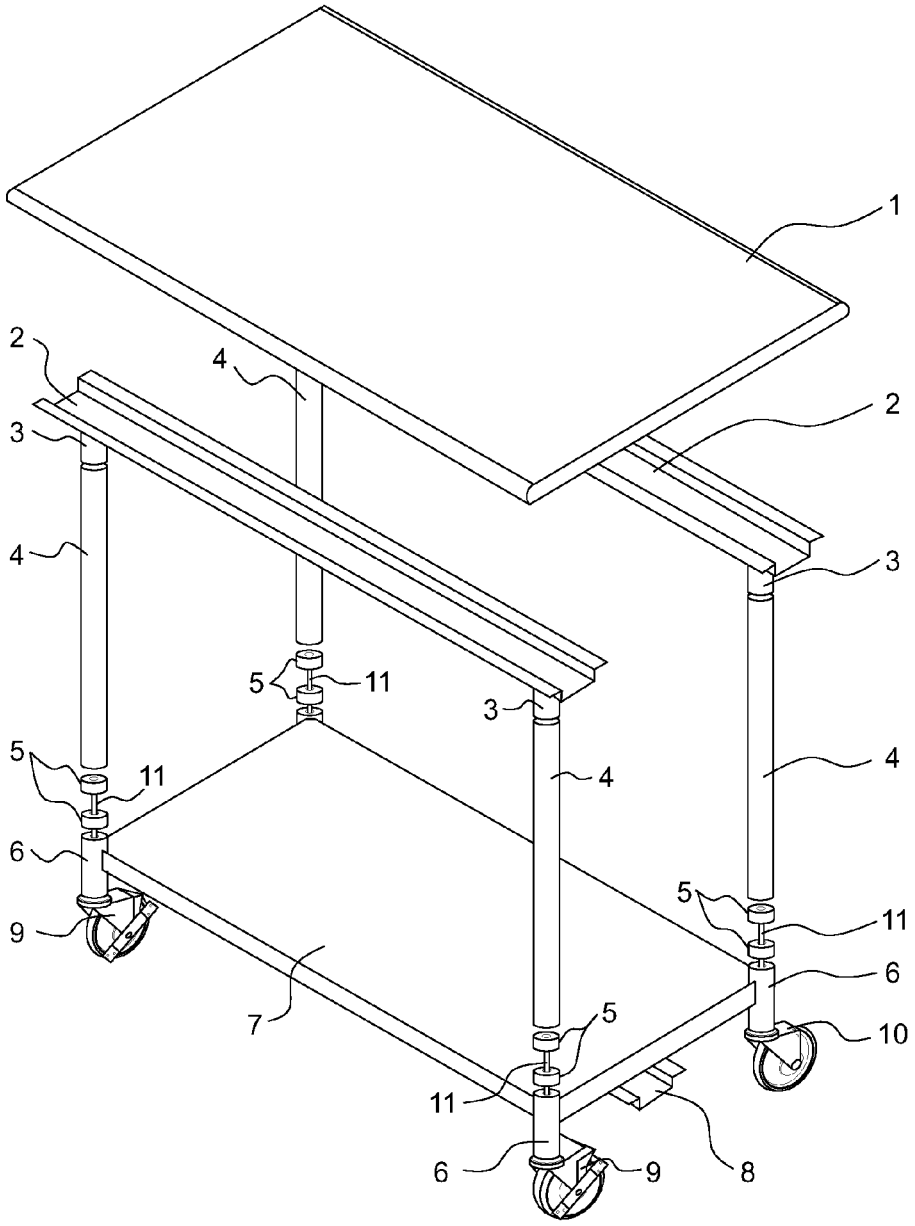
FIG. 1 shows an exploded view of the parts used in a preferred food preparation table according to the invention with rolling casters.

The invention is conveniently described with reference to the attached drawing figures. In each drawing, similar parts are designated with the same reference numerals.

Figure 2:
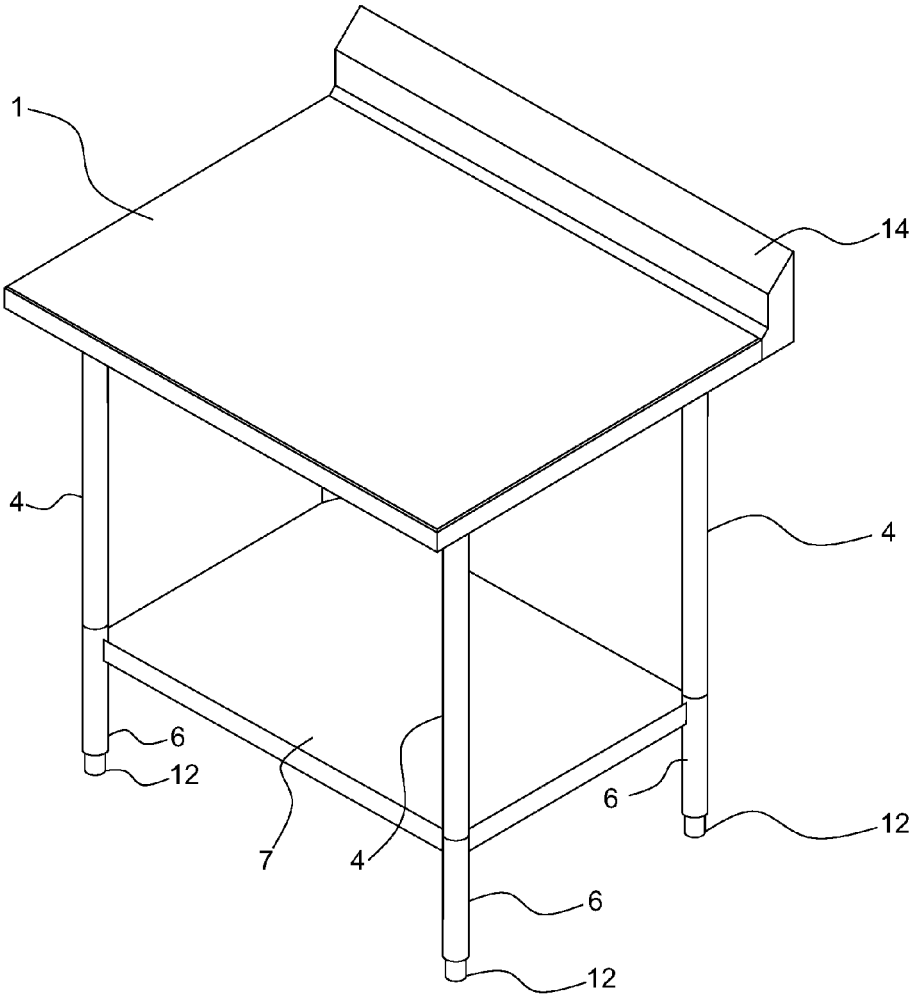
FIG. 2 illustrates a food preparation table according to the invention with fixed supports.
Figure 3:
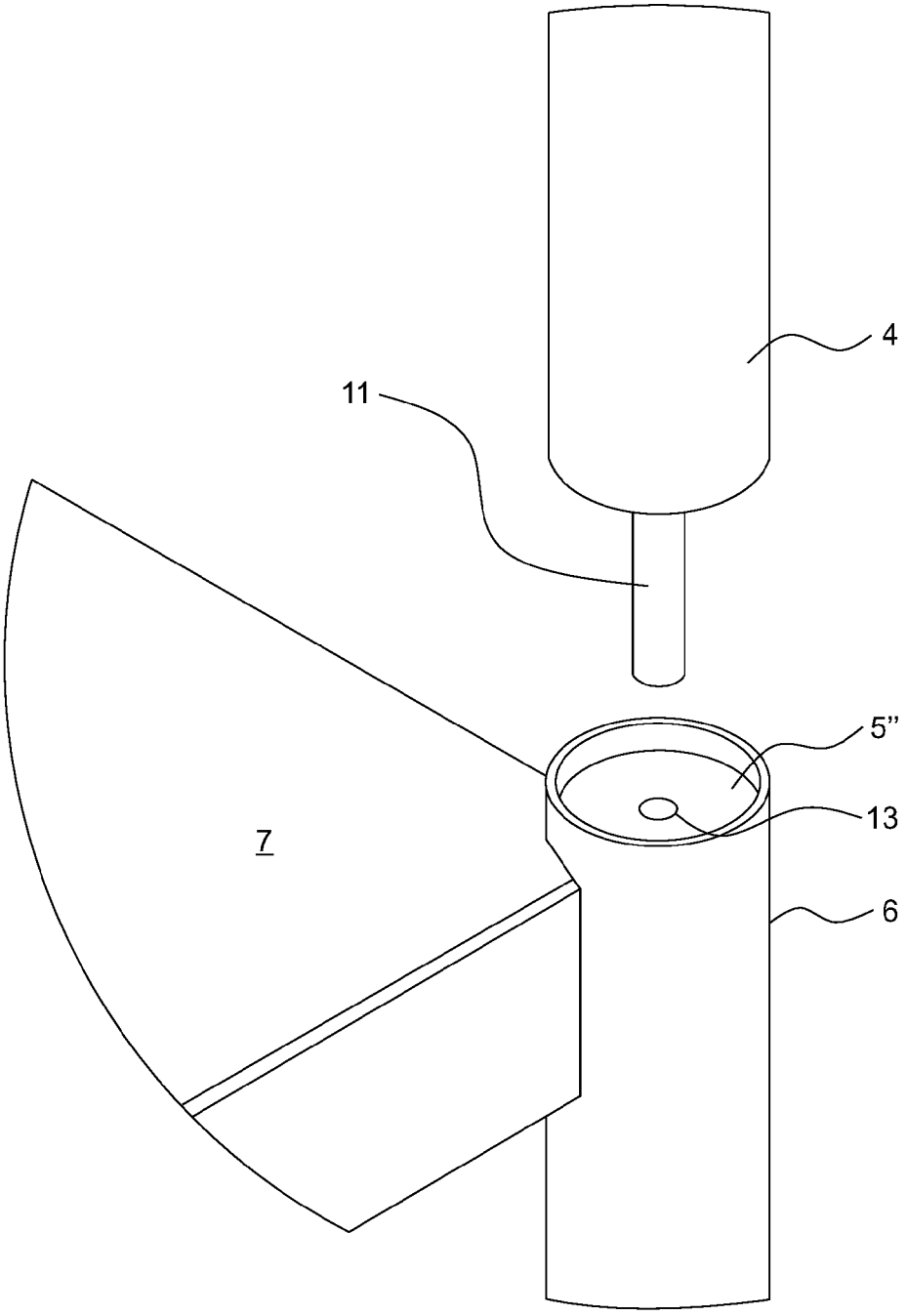
FIG. 3 depicts an undershelf joint according to the invention with a recessed receiving plug in the terminal leg portion and a protruding plug and threaded bolt in the end of the extension leg.

As shown in FIG. 1, rectangular table top 1 is supported by upper stiffening channels 2 that extend along the long dimensions of the table top. The specific length of each upper channel 2 is subject to some variation but is preferably in a supporting relationship along substantially the entire length of table top 1. Optionally, table top 1 can have an integrated or integral backsplash 14 (FIG. 2) and may be made of stainless steel, hard wood suitable for a cutting surface, an open frame for receiving cutting surface inserts, and coated steel with straight, rounded or chamfered edges.

Open leg sockets 3 are attached, preferably welded, to each end of the underside of channels 2. Each socket is made of the same shape type as legs 4, e.g., hollow square or round shapes. Importantly, the inside dimensions of socket 3 are configured to receive the upper end of extension leg 4 in a snug, friction fit.

The lower end of leg 4 and the top end of terminal leg 6 are fitted with connector plugs generally designated as 5 having a threaded central bore 13 to receive threaded bolt 11. In each connection, one of the plugs 5 is recessed into its tubular leg and the other plug protrudes from the end of its legs so that, when connected, one of the plugs spans the connection between extension leg 4 and terminal leg 6 with bolt 11 securing the leg portions together. Bolt 11 may be permanently connected to first plug 5' with an adhesive, spot weld or solder.

Figure 4:
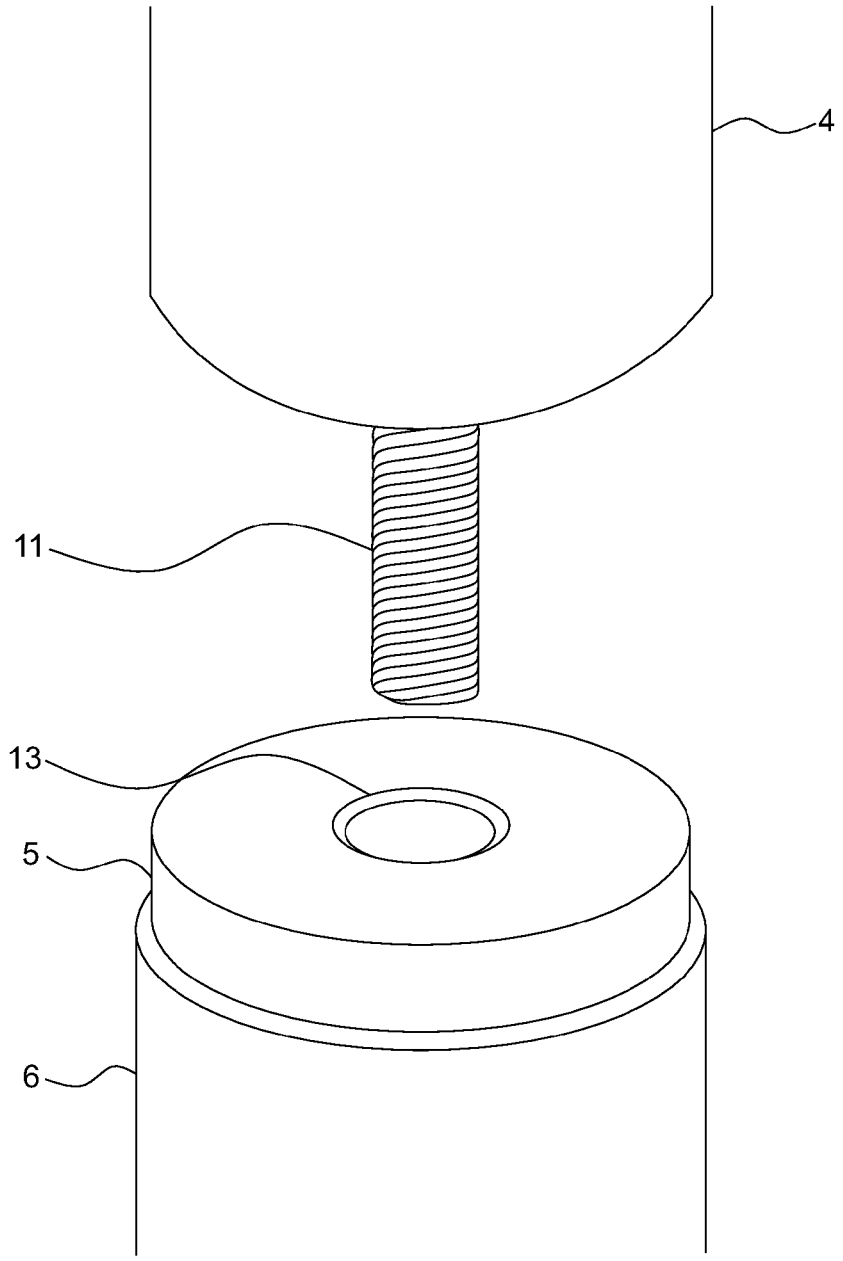
FIG. 4 presents a close-up, external view of an alternative type of joint according to the invention having a protruding plug in the lower leg portion and a recessed plug and extended bolt in the extension leg.
Figure 5:
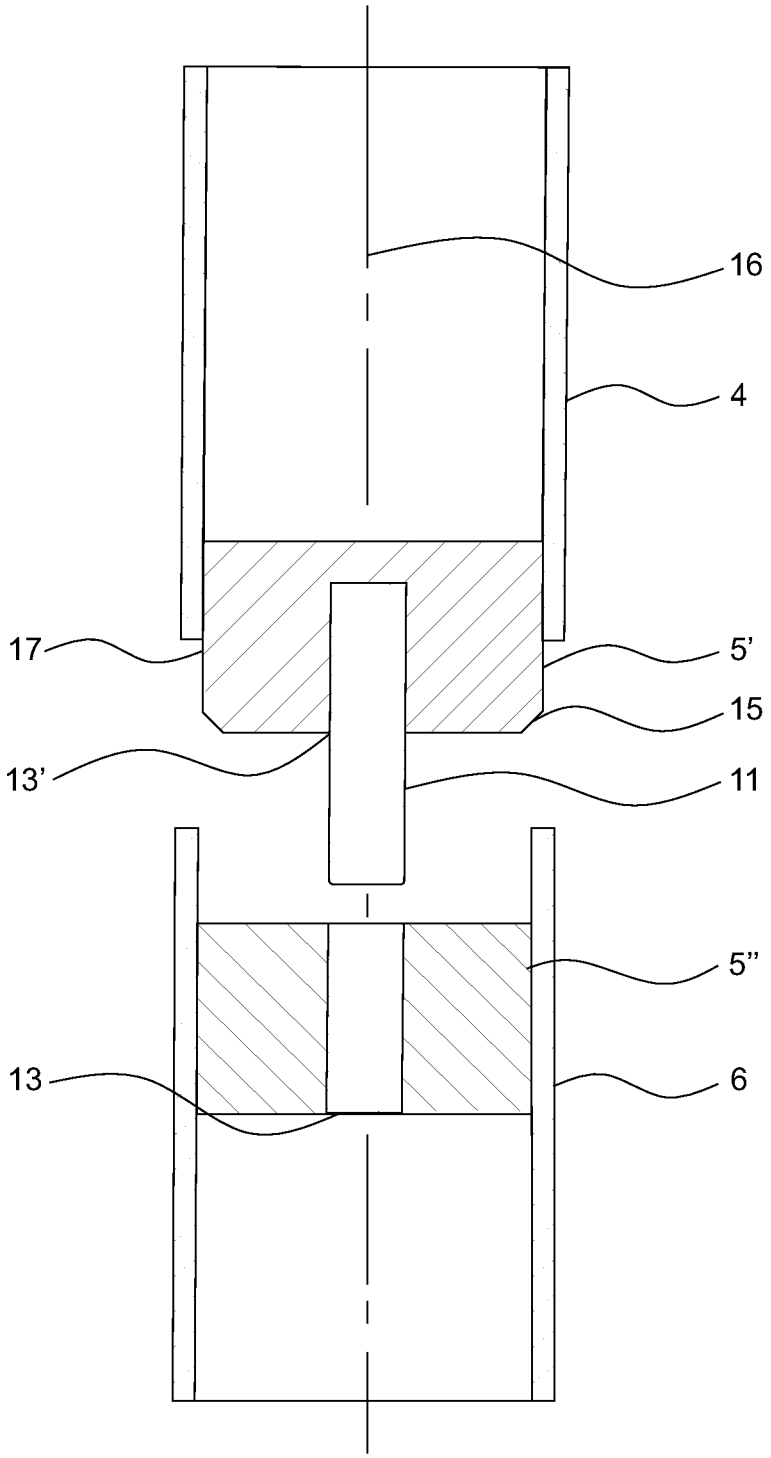
FIG. 5 is a cross sectional view of a connection according to the invention.
Figure 6:
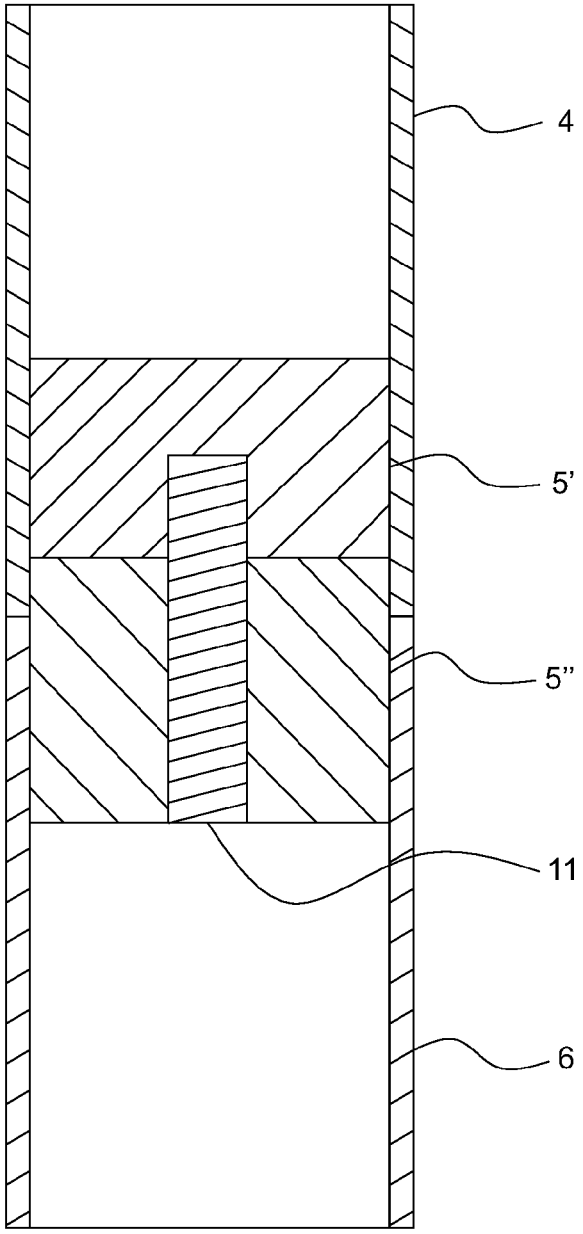
FIG. 6 is a cross sectional drawing of the completed joint connection from FIG. 4 in which the threaded connector bolt extends all the way through the connector plug.

As shown in FIG. 4, extension leg 4 can have first plug 5' recessed while second plug 5" in terminal leg 6 can protrude. FIG. 5 illustrates the reverse connection in which first plug 5' protrudes from extension leg 4 while second plug 5" is recessed into terminal leg 6. Plug 5' is also shown as having a central, threaded bore 13' that extends into plug 5' but does not extend all the way through plug 5' as well as chamfer 15 that can facilitate assembly of extension leg 4 and terminal leg 6. Central, threaded bore 13 in plug 5" is shown as extending all the way through plug 5" and, in FIG. 6, all the way through both plugs 5' and 5". It will be understood that either of plugs 5" and 5" can be used in extension leg 4 or terminal leg 6 for the preferred connection of the invention.

Plugs 5' and 5" preferably have a shape to fit firmly within extension leg 4 and terminal leg 6 by friction fit, with or without welding, spot welding or adhesive. Round shapes are preferred to facilitate a connection by twisting. The outer circumference 17 of either of plugs 5' or 5" can exhibit a friction-enhancing textured or surface feature to facilitate a firm connection inside the respective leg segment. Such surface features can include knurling, cross-hatching or grooves that are not parallel to leg axis 16.

Preferably, plugs 5 are tightly friction fit or spot welded inside its respective tube so as to provide substantially rigid connections. Bolts 11 can be provided as loose parts for insertion at the point of assembly or secured within a plug 5 preferably within the plug which is then inserted into extension leg 4, so that twisting extension leg 4 can advance bolt 11 into the plug of terminal leg 6 until a tight connection is formed.

The connection between extension leg 4 and terminal leg is straight, i.e., along leg axis 16, by twisting extension leg 4 with bolt 11 into the second threaded plug 5' in terminal leg 6 so that the twisting action draws the protruding plug into the other leg to occupy the space of the recess of the other plug. Preferably, the advance of the first plug causes the first and second plugs 5', 5" to become abutted and thereby provide a substantial contact surface to prevent loosening of the connections during lateral movement or forces on the table top. See FIG. 6. It will be understood, as noted above, that either of plug 5' or plug 5" may be configured to protrude from its leg segment but that both are preferably not protruding (for visual aesthetics and structural rigidity) or recessed in the same connection.

Figure 9:
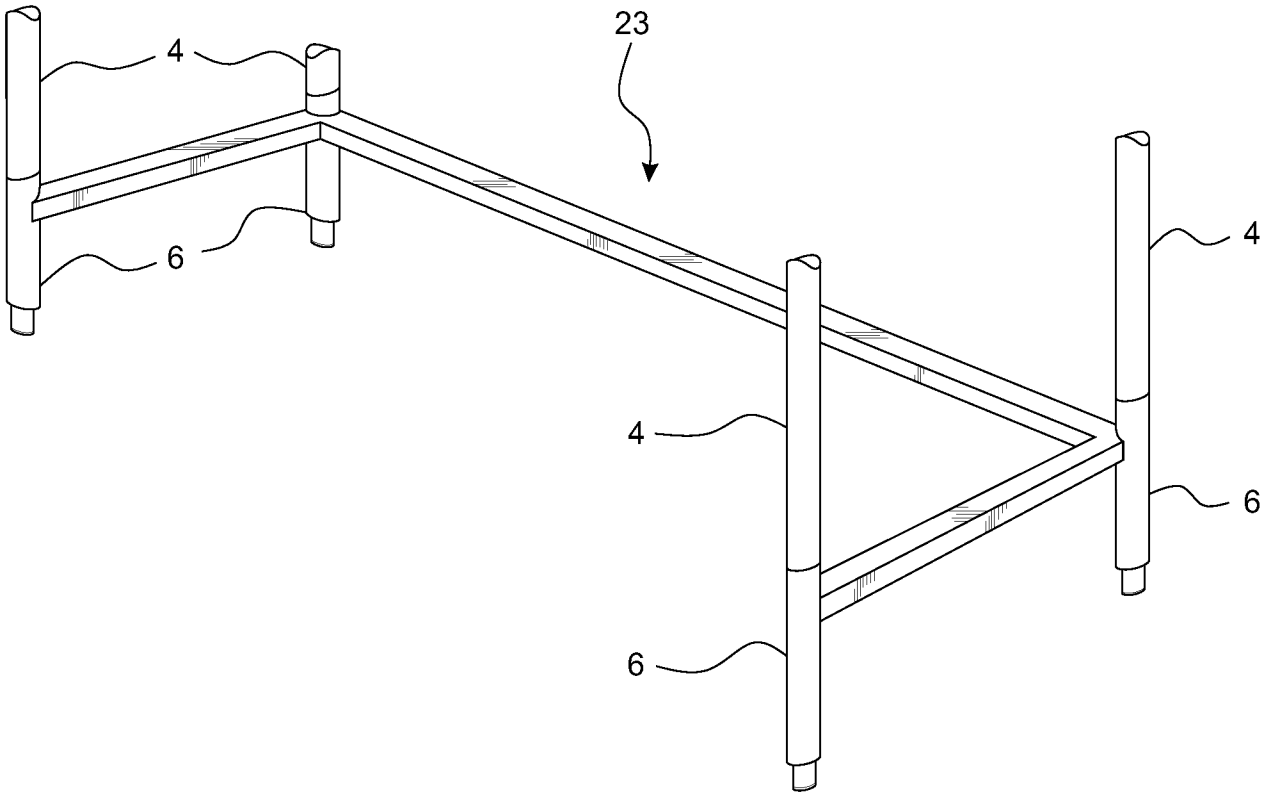
FIG. 9 shows a C-shaped frame undershelf.
Figure 10:
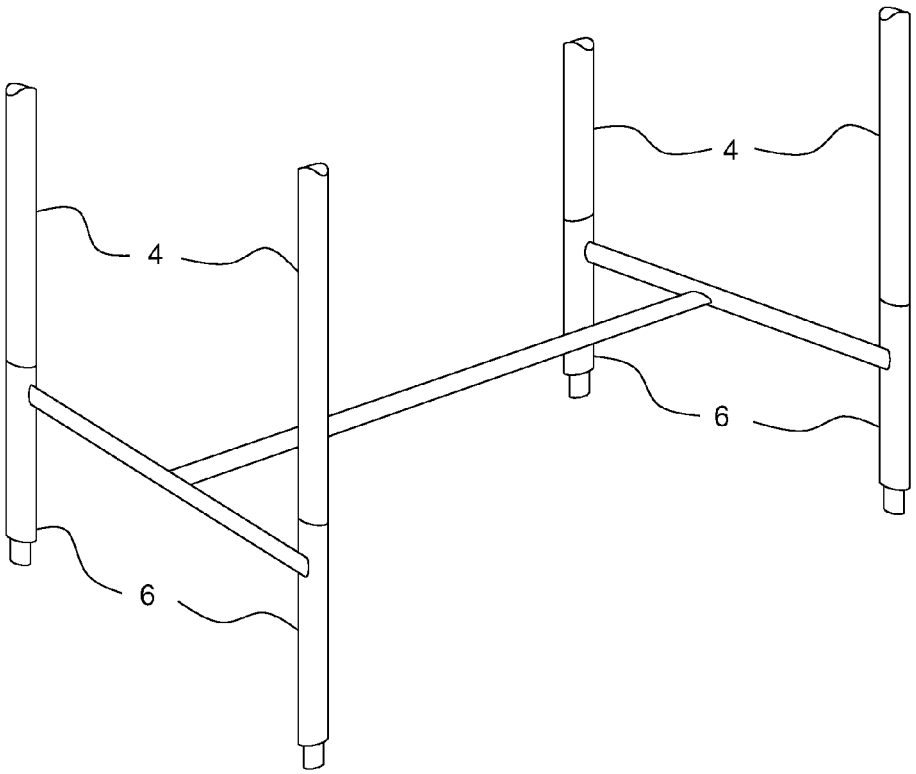
FIG. 10 shows a cross rail undershelf with one cross rail tube member.
Figure 11:
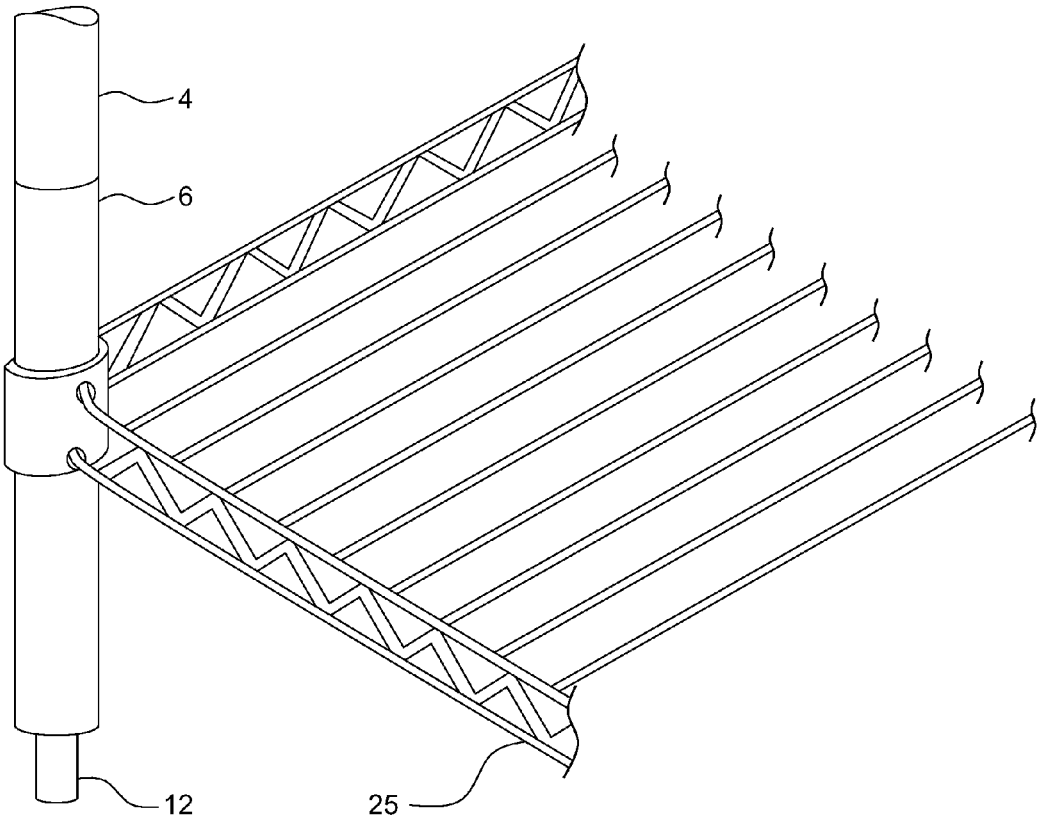
FIG. 11 shows an embodiment with a wire undershelf welded to the terminal leg.

Rectangular undershelf 7 is preferably welded to each of terminal legs 6 at the corners of undershelf 7. The rigid connection of terminal legs 6 to undershelf 7 and its vertically folded edges form a rigid support for extension legs 4 and terminal legs 6. Undershelf 7 can be in the form of: (a) a solid metal shelf (see FIGS. 1 and 2) suitable for industrial use; (b) a cross tube support comprising one or more welded and interconnected metal cross tubes 24 that extend parallel to a working edge of the table top and between welded tubes connecting front and back terminal legs 4 (see FIG. 10); (c) a wire shelf 25 (FIG. 11) of the type shown in U.S. Pat. No. 6,068,143, which is hereby incorporated by reference, that are adapted in terminal connections to be welded and secured to terminal legs 6 at each end; or (d) an open frame of three metal tubes of round or rectangular cross section that are welded at each end to form a rigid, open, C-shaped frame 23 (FIG. 9) that allows boxed products to be stored under the assembled table. Preferably, all metal parts used in the undershelf are made of stainless steel. Braking casters 9 and/or rolling casters 10 can be installed into the lower ends of terminal legs 6 (FIG. 1) or adjustable feet 12.

Undershelf 7 is preferably reinforced along its central length against flexure from the weight of product containers stored thereon with at least one lower support channel 8.

Figure 7:
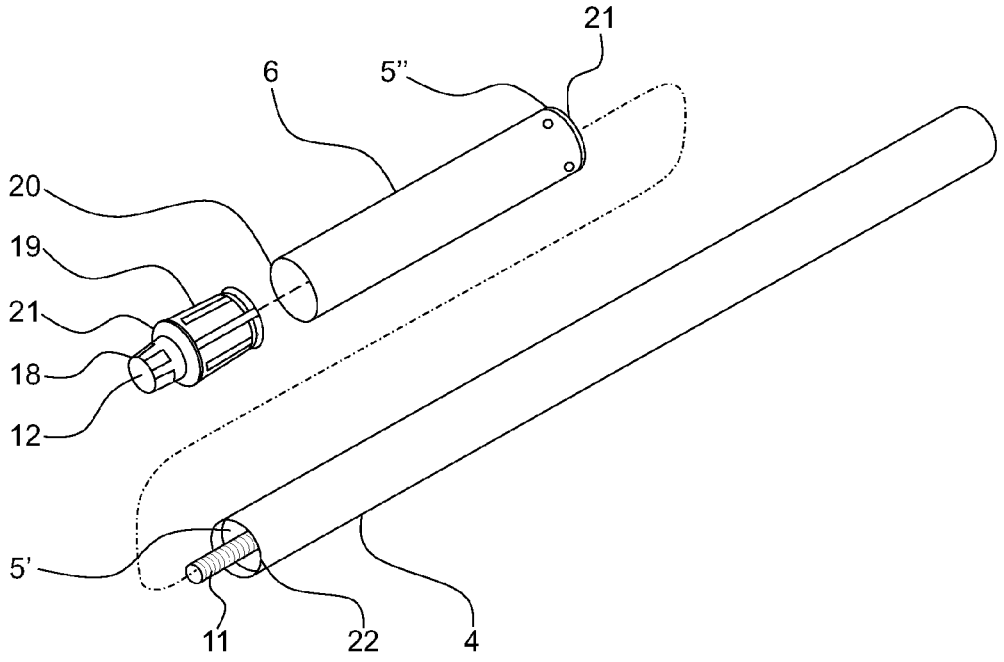
FIG. 7 is an exploded parts view of the leg connection parts.
Figure 8:
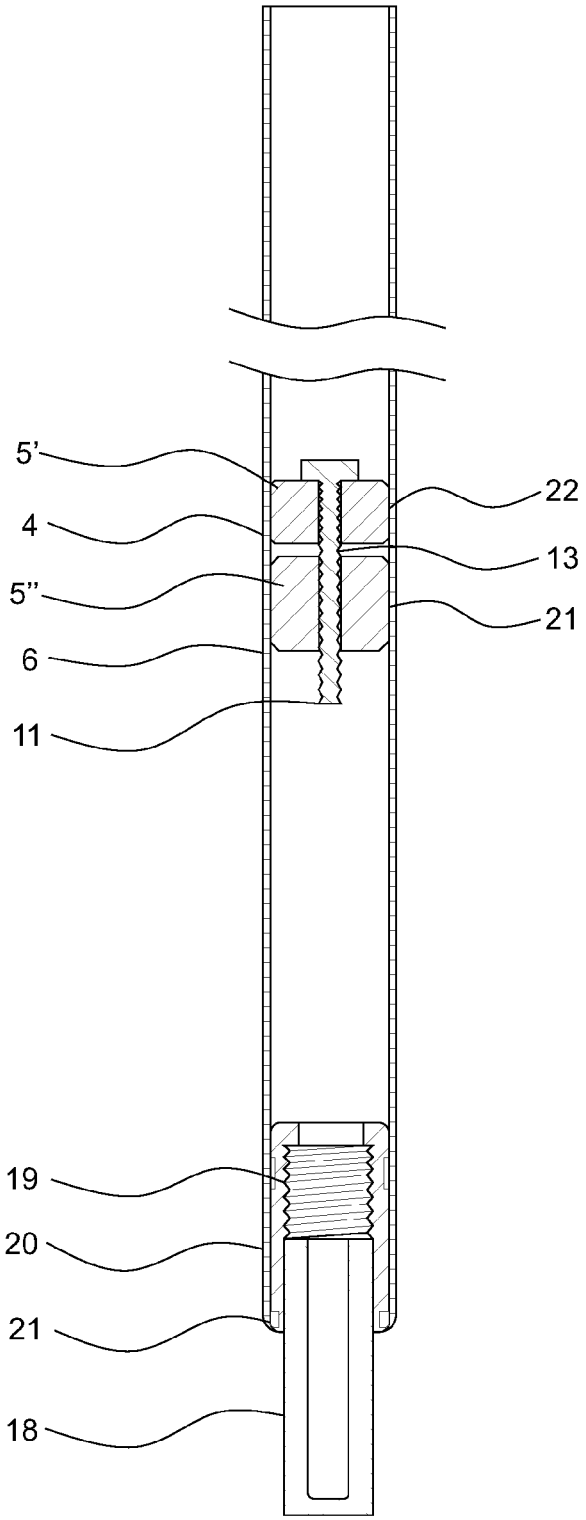
FIG. 8 is a cross section view of a connected extension leg and a terminal leg.

FIGS. 7 and 8 show greater details of legs 4 and terminal legs 6 before an undershelf 7 is welded to terminal legs 7. Adjustable foot 12 having externally threaded post 18 that has been twisted into internally threaded sleeve 19 is press fit into terminal end 20 of terminal leg 6 until sleeve shoulder 21 abuts the edge of terminal end 20.

Leg 4 is connected to terminal leg 6 by way of bolt 11 that is secured in inset plug 5'. Bolt 11 is then twisted into central bore 13 of protruding lower plug 5". As shown, first connecting end 21 of terminal leg 6 abuts second connecting end 22 of extension leg 4.

What is claimed is:

1. A knock down food preparation table that comprises:

a. a rectangular table top with a top side, an underside and four corners, wherein said table top is stainless steel and further comprises:

i. a pair of support rails extending the length of said table top, wherein each of said support rails exhibits a C-shaped cross section with pair of parallel upper flanges on either side of a central channel, wherein said upper flanges are welded to the underside of the table top; and ii. wherein each support rail further includes an open, round, receiving socket at each end of the supporting rail, said socket being dimensioned to receive a first extension leg end portion in a snug, friction fit;

b. four tubular, extension legs of the same length and external dimensions, wherein each extension leg exhibits:

i. a first leg portion end that snugly fits into one of the receiving sockets on the underside of said table top; and ii. a second leg portion end opposite said first leg portion end having a first plug that is secured within said second leg portion end, each said first plug exhibiting an axially-extending, threaded, central bore; and c. a lower support frame comprising four, tubular, terminal legs welded to said lower support frame and that each extend vertically from a top side of said frame to a lower side of said frame at each corner of said support frame, wherein each top end of each terminal leg comprises a second plug fit therein and that exhibits an axially-extending, threaded, central bore to receive a threaded rod so that a second leg portion end of an extension leg can be secured together with said threaded rod, whereby the second leg portion of an extension leg abuts a corresponding top side of a terminal leg around a first plug or a second plug, wherein one of said first plug or said second plug protrudes from its leg portion and extends into a tubular leg segment of the other leg when the first and second leg portions are fully screwed together.

2. A table according to claim 1 wherein the first plug protrudes beyond the end of the extension leg second portion into which it has been secured.

3. A table according to claim 1 wherein the second plug protrudes beyond the top of each terminal leg.

4. A table according to claim 1 wherein a caster wheel is fit into the lower side of each terminal leg.

5. A table according to claim 1 wherein said lower support frame comprises a rectangular undershelf welded to a terminal leg at each corner of said undershelf.

6. A table according to claim 5 wherein said undershelf comprises a sheet of stainless steel.

7. A table according to claim 5 wherein said undershelf comprises a wire shelf.

8. A table according to claim 1 wherein said lower support frame comprises and I-shaped cross tube support that comprises one or more welded and interconnected metal cross tubes extending parallel to a working edge of said table and also between welded tubes connecting front and back terminal legs.

9. A table according to claim 1 wherein said lower support frame comprises an open frame support that comprises three metal support members, two of which are welded to connect a back terminal leg to a front terminal leg, and the third support member connects the back terminal legs together with a welded connection so as to form a rigid, open, C-shaped frame.

10. A knock down table that comprises:

a. a table top having a working top side and an underside having support rails extending the length of said table top, wherein each of said support rails exhibits a C-shaped cross section with pair of parallel upper flanges on either side of a central channel, wherein said upper flanges are welded to the underside of the table top; and wherein each support rail further includes an open, round, receiving socket at each end of the supporting rail, said socket being dimensioned to receive a first extension leg end portion;

b. a rigid, lower support frame comprising at least four, tubular, terminal legs that are welded to said support frame, each terminal table leg exhibiting a top end having a terminal leg plug fit therein and protruding from said top end, each terminal leg plug having a threaded, central bore dimensioned to receive a threaded rod; and c. four extension legs that each removably interconnect the table top and the support frame between a leg receiving socket on the underside of said table top and a threaded central bore of a corresponding terminal leg plug recessed in the leg that forms an annular space between said terminal leg plug and the end of the extension leg, each extension leg having an upper end that is dimensioned to fit within a receiving socket on the underside of said table top and a lower end having a threaded rod extending from the recessed plug to releasably engage the threaded bore of the protruding terminal leg plug of said lower support frame whereby the protruding portion of the terminal leg plug is drawn into the annular space of the extension leg as the threaded connection is made tight, thereby connecting the table top with the lower support frame.

* * * * *